United States Patent [19]

Freiberg

[11] 4,119,129

[45] Oct. 10, 1978

[54] PUTTER COVER

[76] Inventor: James M. Freiberg, 221 Glenview Rd., New Kensington, Pa. 15068

[21] Appl. No.: 834,439

[22] Filed: Sep. 19, 1977

[51] Int. Cl.[2] ..... A63B 57/00

[52] U.S. Cl. ..... 150/52 G

[58] Field of Search ..... 150/52 G, 52 R; 206/315 R, 224, 349, 371; 224/2 E, 26 B, 5 A

[56] References Cited

U.S. PATENT DOCUMENTS

| | | | |
|---|---|---|---|
| 1,633,319 | 6/1927 | Estwing | 224/2 E |
| 2,708,029 | 5/1955 | Kahn | 206/349 |
| 3,051,304 | 8/1962 | Dolgorukov | 206/224 X |
| 3,072,167 | 1/1963 | Banas | 150/52 G |
| 3,593,769 | 7/1971 | Spears | 150/52 G |
| 3,854,639 | 12/1974 | Genchi | 224/2 E X |

FOREIGN PATENT DOCUMENTS

| | | | |
|---|---|---|---|
| 695,166 | 9/1964 | Canada | 206/349 |

*Primary Examiner*—Donald F. Norton

*Attorney, Agent, or Firm*—Webb, Burden, Robinson & Webb

[57] ABSTRACT

A putter cover is particularly adapted for center shafted putters. The cover has a pair of flexible non-elastic sides of at least the same length as the main striking face of the putter head. The sides are joined at the top edge and partially joined along a bottom edge at opposing ends. An opening is formed along the bottom edge which is provided by the partial joinder, so that the putter head can pass through the opening and be covered by the two sides.

6 Claims, 4 Drawing Figures

PUTTER COVER

BACKGROUND OF THE INVENTION

1. Field of the Invention

This invention relates to golf club covers and more particularly to putter covers.

2. Description of the Prior Art

The putter is regarded by golfers as a most delicate instrument and a precision tool accounting for success or failure on the putting green. For this reason many golfers have tried putters with various sized and shaped heads to obtain improvements in their putting game.

Among the various putters are, what is commonly referred to as, the "center shafted putter" which has the shaft positioned along the putter head rather than at one end thereof as do other golf clubs. Although these putters are called center shafted, the shaft is positioned so that the head projects from either side thereof.

The putter traditionally is the shortest shafted club in the players bag and the club head undergoes contact with the other clubs by the removal of clubs from the bag and general movement of the clubs while being transported over the course.

Although scratches on the putter do not objectively effect the performance of the club, there is a psychological effect on the golfer when he uses a scratched putter since it is considered a precision instrument. Steel headed putters may scratch during use but the problem is severe when brass headed putters are used since brass is substantially softer than steel. The brass putters may dent on the striking face which may adversely effect putter performance.

Therefore, manufacturers of golf accessories have endeavored to provide covers for putters (along with other clubs) to prevent scratching and damage to the putter heads. These putter covers have been effectively employed in end shafted putters but little progress has been made in an effective cover for center shafted putters.

Many covers employ fasteners which tend to wear out, or use loosely fitted material which is readily removed from the putter by withdrawal of other clubs. Exemplary of the prior art putter covers are U.S. Pat. Nos. 3,072,167; 3,831,652; and 3,938,570.

Thus a putter cover has been desired which is durable, fits snuggly on center shafted putters, is free of fasteners and the like, and is readily attached and removed.

In accordance with the present invention a putter cover with the above desired characteristics is provided.

BRIEF DESCRIPTION OF THE INVENTION

A putter cover is provided which is particularly adapted for center shafted putters. The cover has a pair of flexible non-elastic sides of at least the same length as the striking face of the putter head. The sides are joined at the top edge and partially joined along the bottom edge at opposing ends. An opening is formed along the bottom edge which is provided by the partial joinder, so that the putter head can pass through the opening and be covered by the sides.

The following drawings will further illustrate, but are not intended to limit the invention.

DETAILED DESCRIPTION OF THE INVENTION

Referring now to FIGS. 1 through 4, all embodiments have a pair of sides. The sides are constructed of a material which is non-elastic such as leather, vinyl or the like. The material of construction should provide a cushioning effect to protect against other clubs which hit the cover from denting the putter. Further, the material of construction should be sufficiently non-elastic so that the cover frictionally engages the club head. Preferably, the two sides are of identical dimensions and are joined along at least the top edge and partially joined along the bottom edge. The joinder at the top edge may be at a single point, a partial joinder or a complete joinder. As the length of the joinder of two edges decreases, the joinder should be centered along the top edge. Optionally the remaining two edges may be joined. When all edges are joined (except for the partial joinder on the bottom edge) the sides must be longer than the putter head. When, only one edge in addition to the top and bottom edges are joined, the sides must be at least as long as the main striking face of the putter head to provide adequate protection. The bottom edge is joined at opposing ends thereof to provide an opening for insertion of the putter head.

The joinder of edges may be provided by any suitable means such as sewing, stapling or the like. In addition, a single symmetrical piece may be used to form the two sides by folding along a center line, such fold providing for a joinder of sides in the completed cover.

DETAILED DESCRIPTION OF THE DRAWINGS

Figure 1:
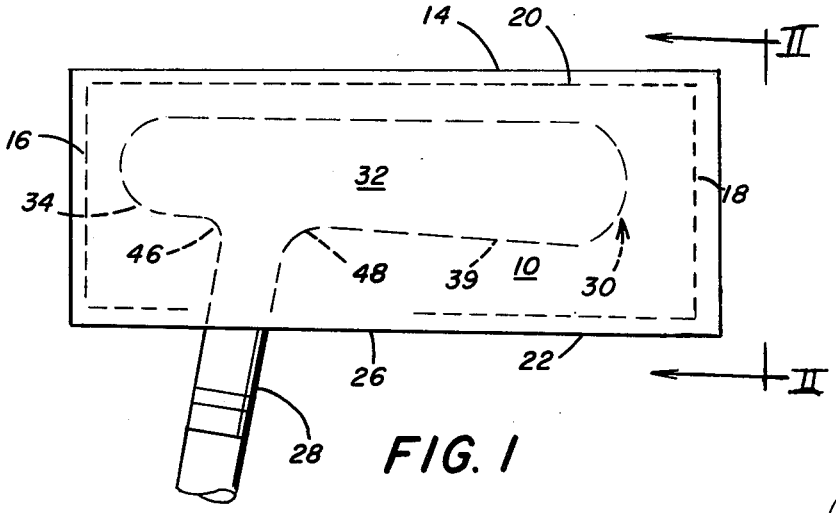
FIG. 1 is a front view of center shafted putter (in phantom) within one embodiment of the invention.
Figure 2:
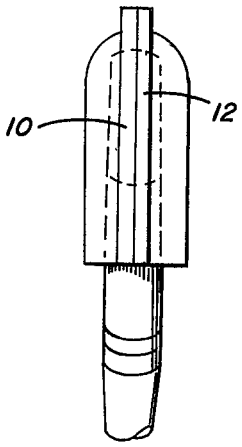
FIG. 2 is a rear view of the embodiment shown in FIG. 1.

Referring now to the embodiment shown in FIGS. 1 and 2, two flexible sides 10 and 12 are constructed of non-elastic material such as leather, vinyl or the like. The top, and side edges, 14, 16, and 18 respectively, of the sides are joined together by a staple or staples 20 which securely fasten the sides together. Along the bottom edge 22, the sides are only partially joined at opposing ends to provide an opening 26 for insertion of a putter 28. In operation the long portion 30 of the putter head 32 is inserted in the opening 26. The thickness of the putter head 32 causes the sides 10 and 12 to separate, except for the edges held by the staples 20, and be frictionally engaged with the putter head. The leading edge of the putters long portion 30 is inserted angularly and to a point within the cover where the rear short edge 34 of the putter 32 may be passed through the opening 26. The club head 32 is moved rearwardly so that the club edge opposite the shaft is approximately parallel to the edge 14. The club head 32 is frictionally engaged with the sides 10 and 12 thus securing the cover to the club head. In like manner an end shafted putter may be inserted into the cover. Upon removal, the insertion process previously described is reversed.

Figure 3:
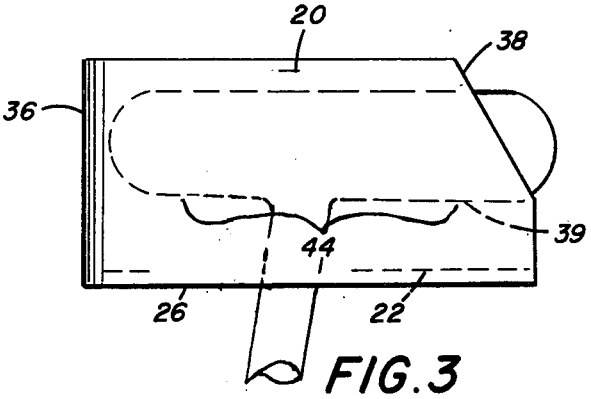
FIG. 3 is a front view of a second embodiment of the invention.

Referring now to FIG. 3 a second embodiment is shown with the top edge 14 of the sides 10 and 12 being joined at a single point with a single staple 20 with one side edge 36 of the two sheets being joined by folding a single sheet. The second side edge 38 is open and bottom edge 22 is partially joined as is shown in FIG. 1. In this embodiment less material is necessary since the large club head edge 39 may pass through the cover at open edge 38 while the putter is being inserted therein while providing protection to the entire club head upon fixing of the putter within the cover. The main striking face 44 of the putter head is enclosed by the cover with part of the club head being exposed. The main striking face 44 is that portion of the club head used by most golfers to hit the golf ball.

Figure 4:
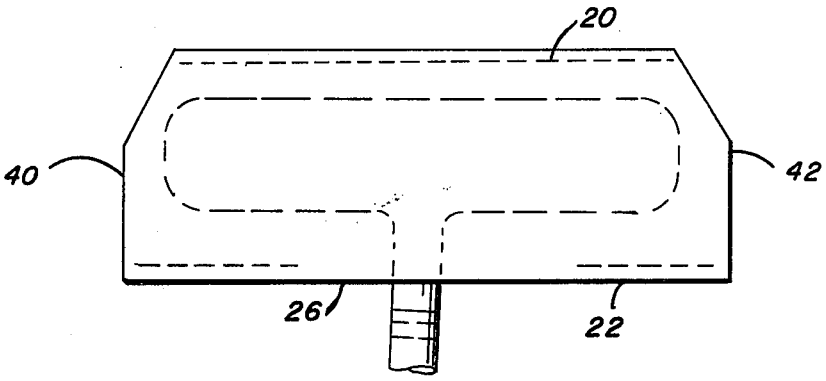
FIG. 4 is a front view of a third embodiment of the invention.

In FIG. 4 a third embodiment of the invention is shown in which the two side edges 40 and 42 are not joined and edges 14 and 22 are joined in the same manner as in FIG. 1.

In all of the embodiments of the invention the opening 26 must be greater than the distance from the heel end 34 of the putter head to the toe edge of its hosel 48 to permit the passage of the putter head into the cover. Further the opening 26 must be smaller than the distance from the toe end 30 to the heel edge 46 of its hosel to provide adequate frictional engagement. When one side edge of the cover is completely joined by staples, a fold or the like the distance from the end of the opening proximate to the joined edge is preferably less than the distance from the heel end of the putter blade to the heel side of the hosel.

Thus in accordance with the invention the bottom edges of the two flexible sheets must be partially joined to provide an opening and the top edges of the two flexible sheets sufficiently joined to provide the frictional engagement of the cover with the club head. However, it is optional to join either one or both side edges of the cover.

What is claimed is:

1. In the combination including a putter and a cover therefor, the improvement wherein said cover is comprised of:

a pair of sides formed of a flexible non-elastic material of at least the same length as the main striking face of the putter head;

said sides being joined at their top edges and partially joined along their bottom edges; an opening formed along the bottom edge of said cover defined by the endpoints of said partial joinder, said opening being greater than the distance from the heel end of the putter head to the toe edge of the putter hosel and said opening being smaller than the distance from the toe end to the heel edge of the putter hosel.

2. The combination of claim 1 wherein said sides of said cover are partially joined at the top edge thereof.

3. The combination of claim 1 wherein said sides of said cover are joined along one side edge thereof.

4. The combination of claim 1 wherein said sides of said cover are joined along both side edges thereof.

5. The combination of claim 1 wherein said material of said cover is leather.

6. The combination of claim 1 wherein said materal of said cover is vinyl.

* * * * *